US005352030A

United States Patent [19]

Derle et al.

[11] Patent Number: 5,352,030

[45] Date of Patent: Oct. 4, 1994

[54] ANTI-TIP DEVICE

[76] Inventors: Wolfgang Derle, 232 Myers Road, Cambridge, Onario, Canada, N1R 7M4; Ronald G. Schenk, 564 Greenbrook Drive, Kitchener, Ontario, Canada, N2M 4K6

[21] Appl. No.: 943,480

[22] Filed: Sep. 11, 1992

[51] Int. Cl.[5] ..... F05C 7/06

[52] U.S. Cl. ..... 312/221; 312/220

[58] Field of Search ..... 312/216–221

[56] References Cited

U.S. PATENT DOCUMENTS

| | | | |
|---|---|---|---|
| 3,323,849 | 6/1967 | Stark | 312/221 |
| 3,454,320 | 7/1969 | Olree | 312/217 |
| 3,874,755 | 4/1975 | Hegg et al. | 312/221 |
| 3,881,793 | 5/1975 | Anderson | 312/217 |
| 3,900,236 | 8/1975 | Goulish et al. | 312/217 |
| 4,272,138 | 6/1981 | Stark | 312/221 |
| 4,298,236 | 11/1981 | LaRoche | 312/215 |
| 4,355,851 | 10/1982 | Slusser | 312/215 |
| 4,429,930 | 2/1984 | Blouin | 312/216 |
| 4,480,883 | 11/1984 | Young | 312/220 |
| 4,936,640 | 6/1990 | Pratzer | 312/221 |
| 4,966,423 | 10/1990 | Higuera | 312/219 |
| 5,056,877 | 10/1991 | Westwinkel | 312/221 |
| 5,074,627 | 12/1991 | Broeders | 312/221 |

*Primary Examiner*—Flemming Saether

[57] ABSTRACT

In a filing cabinet arrangement of vertically disposed drawers mounted on progressive two or three channel drawer slides an improved interlock or anti-tip mechanism is used. By means of a uniquely configured cam, the cabinet of drawers provides both an anti-tip mechanism as well as an anti-rebound quality which ensures that a drawer, once returned to the cabinet, does not rebound outwardly. In addition, this device will act as a security lock mechanism in conjunction with installed locking apparatus. The particular inventive features lie in the simplicity of the mechanism and in its space saving qualities. No additional space in a cabinet, other than that required for the drawers and the drawer slides, is necessary. The mechanism is economical, simple and worry free in its operation. It is adaptable to any file cabinet situation where two or three channel progressive drawer slides are used.

12 Claims, 7 Drawing Sheets

ANTI-TIP DEVICE

FIELD OF INVENTION

This invention relates to drawers and filing cabinets, and more particularly relates to an anti-tip or interlock device combined with an anti-rebound device.

It is well known in the art that when filing cabinets, having a plurality of drawers, are filled with filing material, the weight of such cabinets is enormous. When one drawer is opened to its fullest extent to view the documents therein, the center of gravity is offset, and the opening of a second or third drawer can cause the filing cabinet to tip over and cause serious injury to the user.

BACKGROUND OF THE INVENTION

For many years file cabinet manufacturers have installed various devices known as interlock or anti-tip devices in file cabinets. Thus, when one file cabinet drawer is opened, the remainder of the file cabinet drawers are locked and cannot be opened until the first drawer has been returned to a closed position.

Most of these devices installed to one side of the cabinet employ some sort of projection which extends perpendicularly from the side of the drawer. When the drawer is opened, the projection on the drawer triggers a series of levers and cams which tend to jam, in one way or another, the other drawer mechanisms, preventing the associated drawers from opening.

Most commonly, a frame with a vertically aligned U-shaped channel is mounted on the inside of the cabinet and a plurality of vertically aligned locking bars move upwardly or downwardly when one of the drawers is activated. A cam or lever is usually mounted on one of the locking bars or on the side of the vertical channel. Such a device is found in U.S. Pat. No. 3,900,236, issued Aug. 19, 1975 to Goulish.

A more recent type of device is found in U.S. Pat. No. 4,936,640, invented by Isy S. Pratzer, which issued on Jun. 26, 1990 for ANTI-TIP MECHANISM AND METHOD PROVIDING ANTI-TIP DEVICE.

Still other anti-tip devices employ a series of linked cams which pivotally connect to adjacent cams on the adjacent drawer system. Such a device is found in U.S. Pat. No. 4,429,930.

Another method of accomplishing the same task is to employ elongate rods vertically mounted on the side of the cabinet with cam members fixed for simultaneous rotation on the rod. When a drawer is opened, the remainder of the drawers are prevented from moving past their respective cams. One of these older types of devices is found in U.S. Pat. No. 3,881,793—Anderson.

Although many of the new anti-tip devices function extremely well, and are very dependable, two problems still exist in the art. One is the complexity of the devices, i.e. the number of moving parts necessary for operation. A more serious drawback however is the wasted space necessary to house the devices in the cabinet. Obviously the addition of vertical tracks, frames, sliding bars, perpendicular protrusions, and other components necessitate a much larger cabinet than is needed to house the drawer slides and the drawers alone. This is an important consideration since space is a key factor in most offices.

Moreover, none of the present interlock devices incorporate an anti-rebound means. Anyone who has quickly closed a file cabinet drawer knows the problems associated with the drawers banging into the rear of the cabinet and then rebounding outwardly. If one drawer is closed while another is opened, simultaneously, the rebound of the second drawer could cause the interlock or anti-tip mechanism to malfunction. Thus, it is an added benefit to incorporate an anti-rebound device within an interlock system.

It is therefore an object of the present invention to create a combination improved interlock anti-tip and security locking device which is capable of functioning within the same space as is defined by the two or three channelled drawer slides installed to left-hand or right-hand side within the cabinet.

SUMMARY OF THE INVENTION

Therefore, this invention seeks to provide an interlock and anti-rebound mechanism for a multi-drawer file cabinet having a vertical series of drawers, each of which is mounted on a pair of progressive drawer slides comprising at least two channel slides, slidably mounted to one another for individual opening and closing movement of the drawer, said interlock and anti-rebound mechanism comprising: a spring base plate fixedly mounted on a first channel slide; said spring base plate having at least one aperture in its base and including a raised portion at each end; each of said end portions including an elongate rectangular slit therethrough; each of said slits being adapted to receive a curvilinear end portion of a vertically aligned locking bar when in operation; an activator cam pivotally mounted through an aperture in said spring base plate to said first channel slide and adapted to move said locking bars outwardly from and inwardly toward said spring base plate; said activator cam comprising at least three different axially-spaced configurations, including an upper L-shaped configuration, and a pair of right angled projections extending at substantially right angles to a web of a second channel slide and integral therewith; said projections adapted to rotate said L-shaped portion of said activator cam from a drawer-open/locked position to a drawer-closed/unlocked position; wherein, in operation, when one of said drawers is pulled outwardly from said cabinet to an open position, said projections interact with said L-shaped portion of said cam and rotate said cam 90 degrees such that a second different axially-spaced configuration of said cam urges an upper and lower locking bar outwardly from said spring base plate, thereby exerting pressure on activator cams and locking bars associated with each other of said drawers in said cabinet, thus preventing the remainder of said cams from rotating and said other drawers from opening; and when said drawer is retracted into said cabinet, said cam is rotated in the opposite direction 90 degrees to a drawer-closed position permitting said locking bars to move inwardly toward said spring base plate and permitting rotation of any one of said cams associated with said other drawers.

In a preferred embodiment a cam is used comprising four axially-spaced different configurations comprising a first outer L-shaped configuration, a second round base plate configuration, a third elongated elliptical configuration, and a fourth inner, or bottom, square configuration.

In the present invention, a typical file cabinet is used with a number of vertically stacked drawers. The drawers are horizontally mounted on three-channelled drawer slides for extension from or retraction into the cabinet. The three channels consist of a small inner channel which is attached to the side of the drawer, an outer larger channel slide which is attached directly to the cabinet wall, and an intermediate channel which is slidably mounted between the inner channel and the outer channel with ball bearings in retainer cages.

In order to accommodate the anti-tip anti-rebound mechanism, the top and bottom side flanges of the large channel slides terminate near the rear portion of the channel. Mounted on this rear portion of the outer large channel slide is a spring base plate. This is mounted to the slide by means of rivets. The top and the bottom ends of the spring base plate are enclosed with a vertically aligned slot or aperture in each end. Each aperture is adapted to receive a connecting stub of an interlock bar. The interlock bars are mounted at right angles to the horizontally mounted drawer slides.

Each drawer and drawer slide has an upper and lower locking bar. The uppermost portion of the upper locking bar is connected to an interconnecting stub which fits into the slot of the spring base plate of an upper adjacent drawer slide and similarly, the lowermost portion of the lower locking bar is connected to an interconnecting stub which fits into the upper slot of the spring base plate of a lower adjacent drawer slide. Similarly, locking bars continue to join spring base plates of adjacent drawers until the top and the bottom of the cabinet is reached. The locking bars do not require any guiding vertically mounted channels. They simply fit into the respective upper and lower apertures of adjacent spring base plates. When all drawers are in the closed position, there is a small amount of play between these vertically aligned bars allowing for any one of the drawers to open.

The rear portion of the inner slide has a pair of protruding right-angled ears or flanges which are bent at 90 degrees to the web.

Pivotally mounted on the spring base plate by means of a rivet which passes through the spring base plate to the large channel slide is a cam which is moulded with four different axially-spaced configurations. The top configuration is L-shaped and adapted to engage the two protruding ears of the small channel slide.

Adjacent the L-shaped portion of the cam is a substantially round base portion configuration. Below the base portion of the cam is an elongated elliptical projection which is adapted to engage the curvilinear ends of the interconnecting stubs of the locking bars.

When a drawer is in the closed position, the elongate elliptical projection is substantially horizontally disposed permitting the interconnecting stubs to retract inwardly through the apertures in the spring base plate. However, when the same drawer is opened the cam is rotated 90 degrees and the elongate elliptical projection is vertically disposed thus moving the upper and lower interconnecting stubs outwardly from the spring base plate. This causes adjacent locking bar interconnecting stubs to put pressure on the elliptical elongate projections of adjacent cams and thus prevents rotation of these adjacent cams. As a consequence, adjacent drawers are prevented from opening.

The spring base plate has a substantially square central aperture in its web. The aperture is bounded by a pair of elongate rectangular apertures located on each side thereof. This permits the central aperture to have a limited amount of resiliency. The aperture is adapted to receive the lowermost portion of the cam which is substantially square in configuration. This bottom portion of the cam, in conjunction with the resilient substantially square aperture in the spring base plate, acts as an anti-rebound mechanism.

In a drawer-open position or a fully closed position, the square configured portion of the cam is in register with the substantially square aperture in the spring base plate. However, movement of the cam from the closed to open, or open to closed position of the drawer results in increased friction between the aperture in the spring base plate and the square configured portion of the cam. This friction resists closing or opening of the drawer.

The entire mechanism of the present invention, including the interconnecting locking bars, spring base plate, cam, and protruding ears or projections on the small channel slide are located within the confines of the space bounded by the outer surface of the inner drawer slide and the outer surface of the outer large drawer slide.

Although not shown specifically in the drawings, the invention is also adapted for use with an external lock mechanism and a connecting wedge-shaped activating bar which is substantially parallel to the drawer slides and perpendicular to the interlocking bars. By turning a key or other such means, the wedge-shaped bar is adapted to exert pressure on the entire interlocking stubs at the top, bottom or some other convenient area such that none of the drawers can be opened when in the locked position.

BRIEF DESCRIPTION OF THE DRAWINGS

The invention will be explained in greater detail in connection with the following drawings wherein.

DETAILED DESCRIPTION OF THE INVENTION

Figure 1:
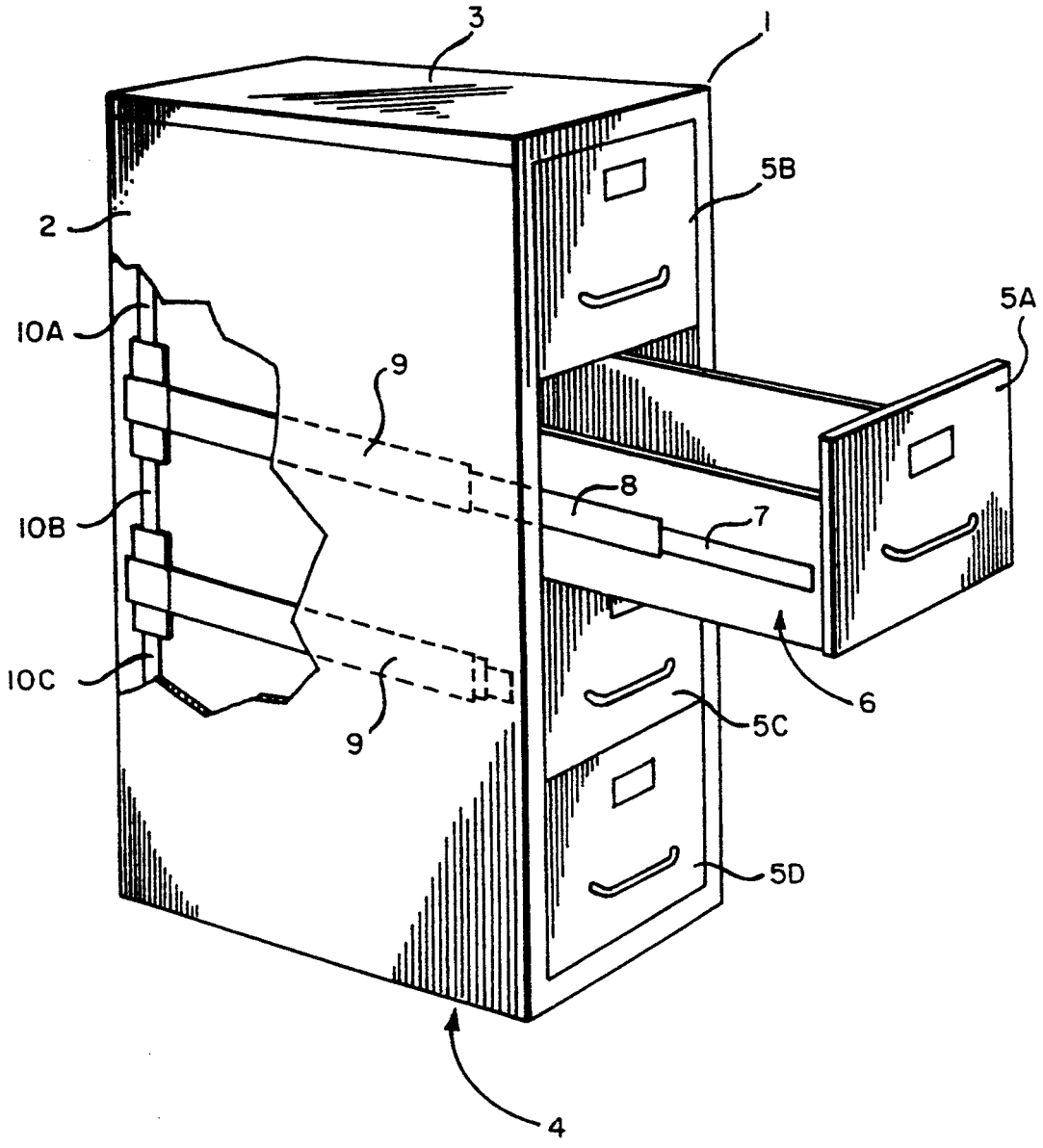
FIG. 1 is a perspective view of a filing cabinet with a portion of the side wall removed.

In FIG. 1 is a drawer cabinet 1 having s ides 2, a top 3 and a bottom 4. A plurality of drawers 5A, 5B, 5C and 5D are mounted in vertical alignment within the cabinet, on horizontally mounted drawer slides. In FIG. 1, drawer 5A is shown in an open position with a three-channel drawer slide extended. Mounted to the side of the drawer 6 is a small inner channel slide 7 , which is slidably mounted within an intermediate channel 8, which is slidably mounted within a large outermost channel 9, which is fixedly attached to the cabinet wall 2. At right angles to the horizontally-mounted drawer slides are a series of interlocking bars which are in vertical alignment and shown generally as 10A, 10B, and 10C.

Figure 2A:
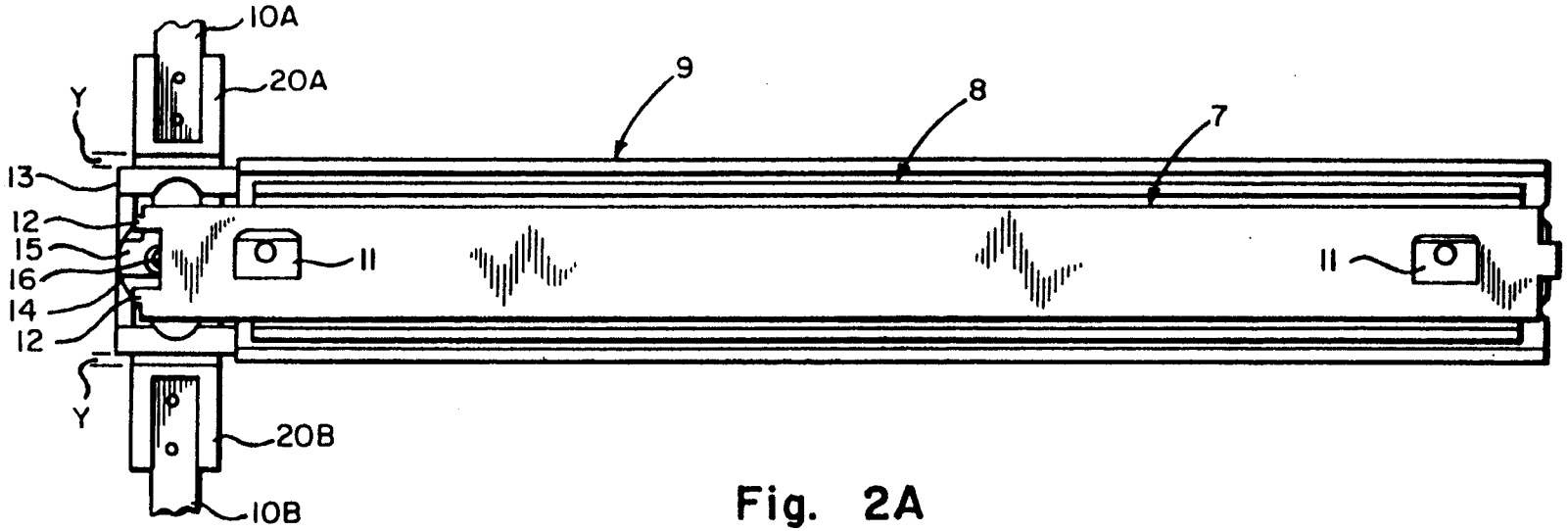
FIG. 2A is a side view of a drawer slide horizontally mounted in the cabinet with a pair of partially exposed locking bars in a drawer slide closed position; the drawer in the cabinet removed for the sake of clarity.

In FIG. 2A a drawer slide located on the right hand side of the cabinet is viewed from the left hand side. The drawer is not shown for the sake of clarity. The drawer slide is in the closed position. The inner channel slide 7 is attached to the drawer by flanges 11. The inner channel slide 7 has at its rear end a pair of projections or ears shown as 12, bent at right angles to the web. These ears or projections 12 are adapted to engage an L-shaped portion 15 of a cam 14 mounted on a spring base plate 13.

The locking bars 10A and 10B are connected to interconnecting stubs 20A and 20B, respectively, which are adapted to fit through end apertures (not shown in FIG. 2A) of the spring base plate 13. The cam 14 is pivotally mounted by means of a rivet 16 which passes through the spring base plate 13 to the large channel slide 9. When a drawer is closed the interconnecting stubs 20A and 20B of the locking bars 10A and 10B, respectively, move inwardly showing a gap of the distance marked as Y.

Figure 2B:
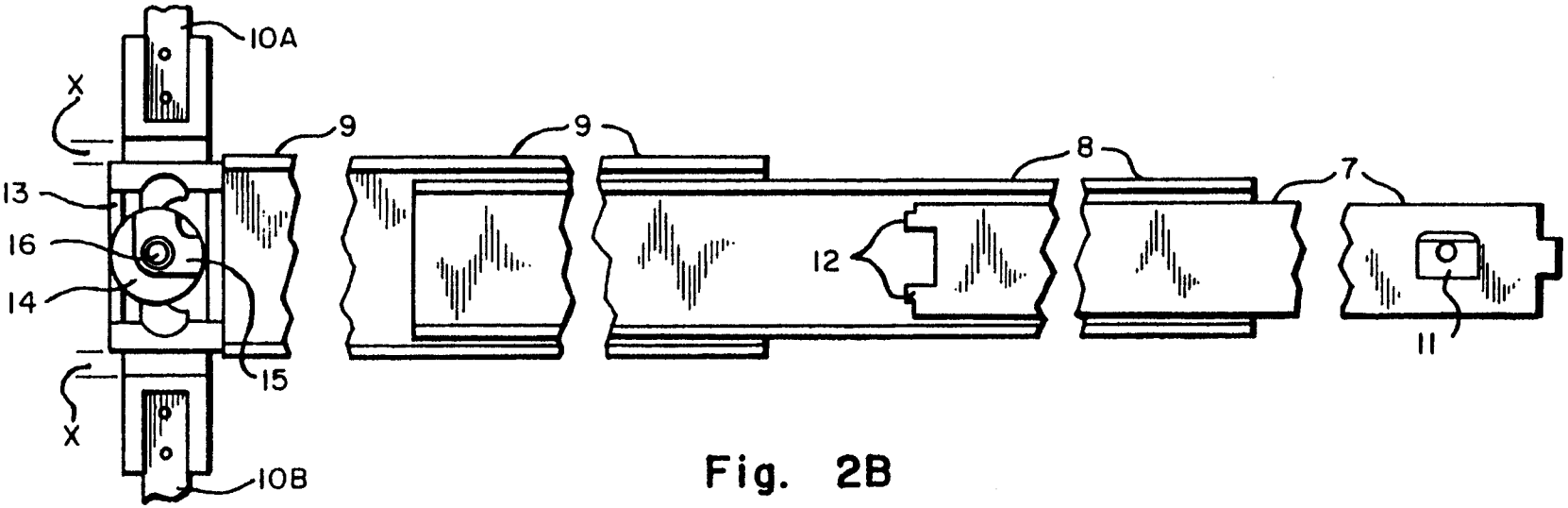
FIG. 2B is similar to FIG. 2A with the exception that the drawer slide is shown in an open position.

FIG. 2B is a similar view to FIG. 2A wherein a three-channel drawer slide and corresponding drawer have been moved outwardly from the cabinet. During the opening of the drawer, the L-shaped configuration 15 of cam 14 has pivoted 90 degrees. One also notes that the former distance Y of the locking bars 10A and 10B has been increased to a distance X.

Thus, when one of the drawers is opened, the opened drawer, its drawer slides and interlock components are in a position as shown in FIG. 2B while the remainder of the drawers, their respective drawer slides and interlock portions, are in a position as shown in FIG. 2A.

Figure 3A:
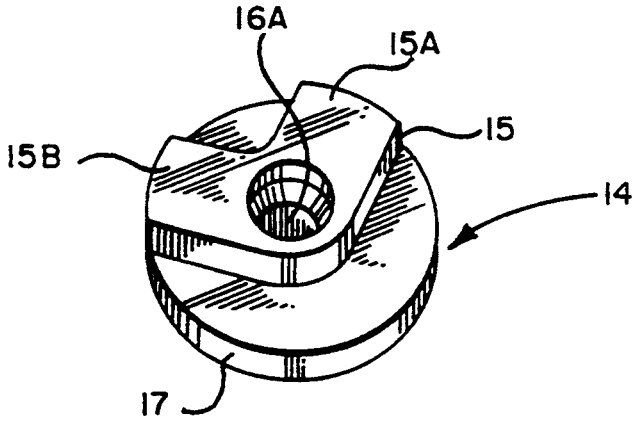
FIG. 3A is a perspective view of the cam of the present invention.

In FIG. 3A, the top of the cam is shown in greater detail. The L-shaped top configurative portion has two ends 15A and 15B. There is an aperture in the center 16A adapted to receive a rivet 16. The L-shaped portion 15 is integral with a rounded base portion 17.

Figure 3B:
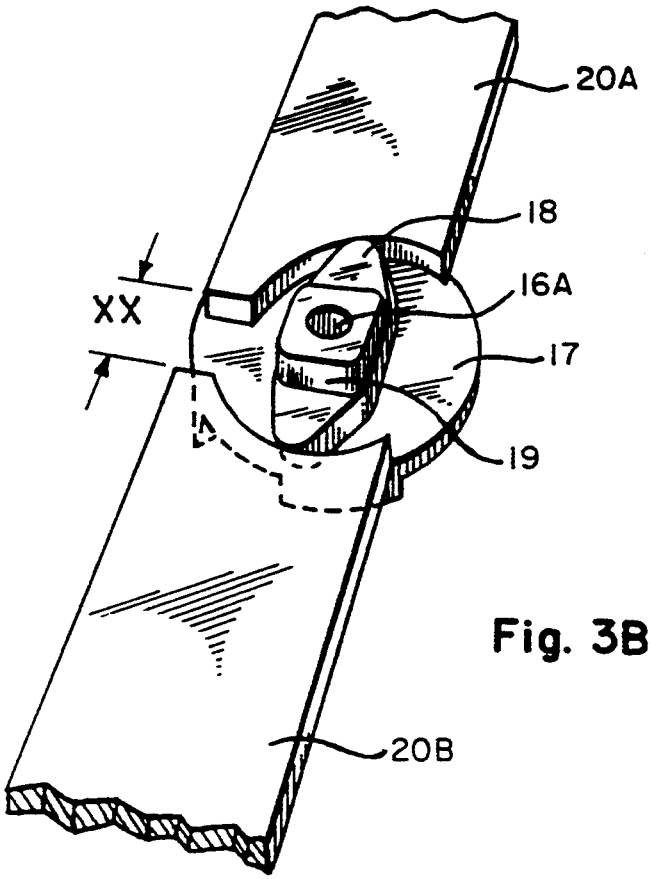
FIG. 3B is a perspective view of the bottom of the cam, in conjunction with a pair of locking bar interconnecting stubs.

FIG. 3B shows the underside of the cam. The cam is shown in a drawer-open position. The elongate elliptical portion 18 is vertically disposed, thereby forcing the interconnecting stubs 20A and 20B of the locking bars outwardly from the spring base plate, leaving a gap of distance XX. The elliptical elongate portion 18 of the cam 14 is in constant frictional contact with the innermost ends of the interconnecting stubs 20A and 20B.

In FIG. 3B, the bottom of the cam, i.e., that portion which is closest to the cabinet wall, is shown as 19. It is substantially square in configuration and is adapted to engage the spring base plate 13 in a manner hereinafter described.

Figure 4:
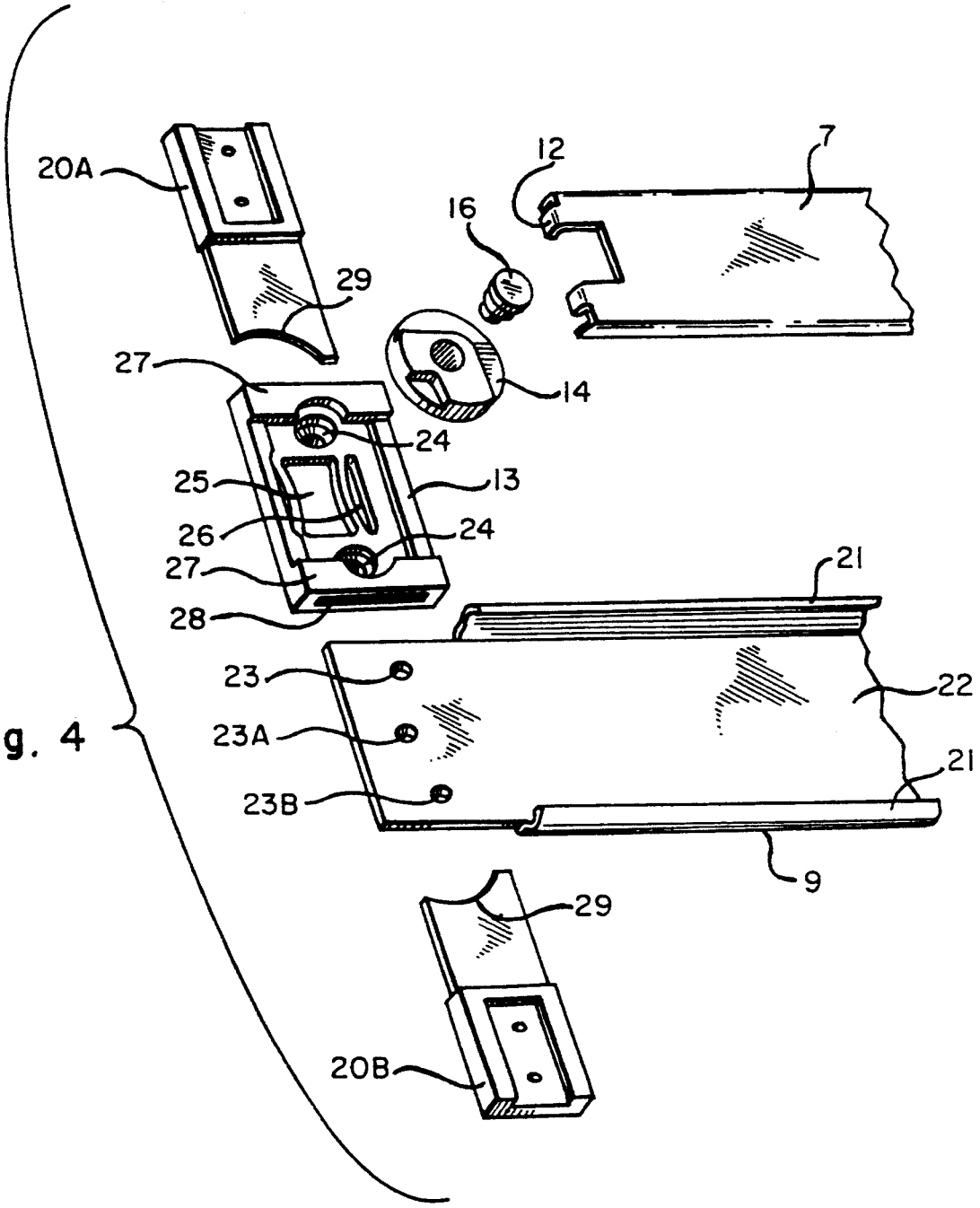
FIG. 4 is an exploded perspective view of the components of the present invention.

In FIG. 4, an exploded view of the major components of the invention is shown. The spring base plate 13 is mounted to the rear portion of large channel 9 by means of rivets through apertures 24 of spring base plate 13 and holes 23 and 23B of the large channel 9. The flanges 21 of the large channel 9 have been removed from the rear portion of the large channel 9 in order to assist the seating of the spring base plate on web portion 22 of large channel 9. The cam 14, by means of a rivet 16, is attached through aperture 25 of spring base plate 13 to the large channel 9, through a central aperture 23A.

The central aperture 25 of spring base plate 13 has resilient sides provided by a pair of elongate apertures 26 located on each side. This aperture is adapted to engage the anti-rebound portion 19 of cam 14. Thus, as cam 14 is rotated the side walls of aperture 25 are adapted to move outwardly and then resiliently spring back when the drawers are in an open or fully closed position. Each end 27 of the spring base plate 13 is moulded in an enclosed formation through which vertically aligned apertures 28 are formed. The apertures 28 are adapted to receive the curvilinear ends 29 of the interconnecting stubs 20A and 20B of the interlock bars 10A and 10B, respectively.

Figure 5A:
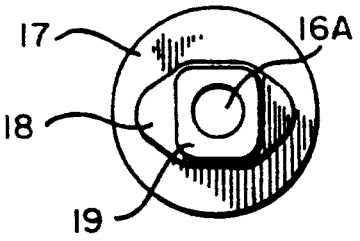
FIGS. 5A, 5B and 5C are a bottom, side and top view, respectively, of the activator cam of the present invention.
Figure 5B:
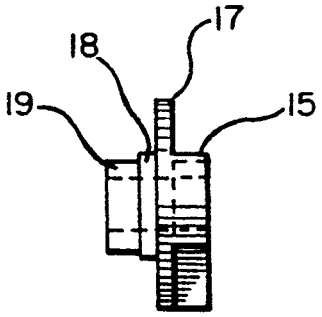
Figure 5C:
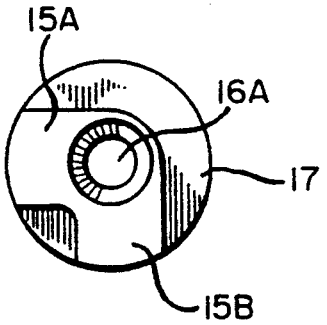

FIGS. 5A, 5B and 5C, illustrate the cam from a bottom, side and top view, respectively.

Figure 6:
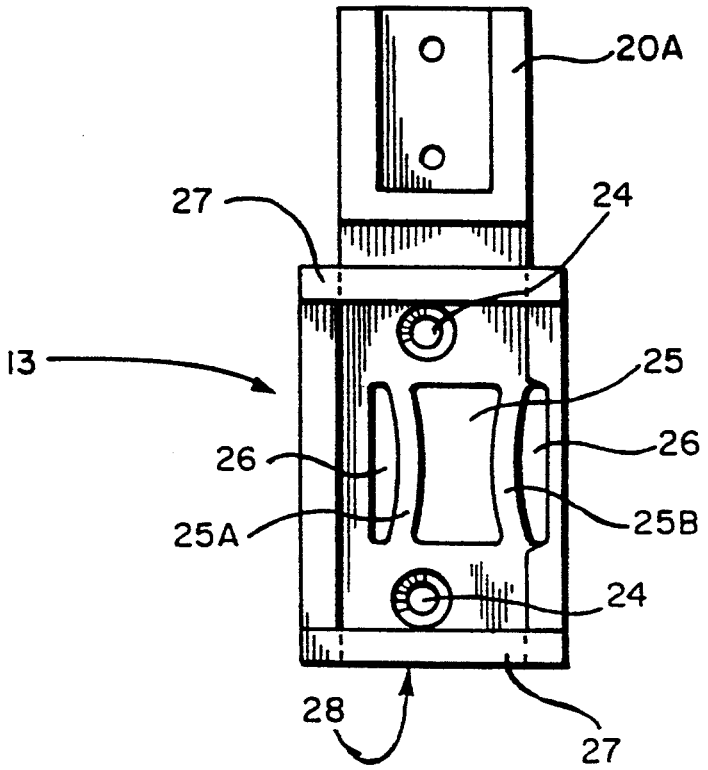
FIG. 6 is a top view of the spring base plate.

FIG. 6 is a detailed top view of the spring base plate showing the resiliently inwardly biased sides 25A and 25B of aperture 25.

Figure 7:
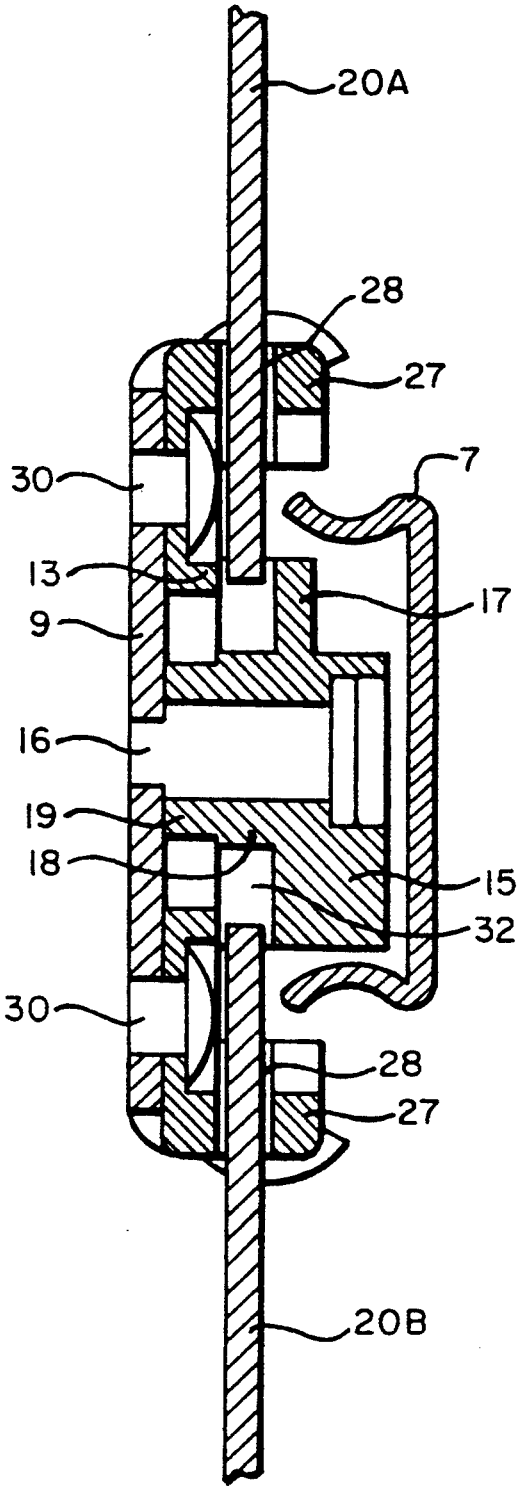
FIG. 7 is a transverse section through the drawer slide in the area of the cam.

FIG. 7 is a transverse cross section of the drawer slide taken through the center of the cam rivet 16. Spring base plate 13 is secured to large channel slide 9 by means of rivets 30. In FIG. 7 a drawer is shown in the closed position with the interlocking stubs 20A and 20B frictionally engaging the elongate elliptical configuration portion 18 of the cam 14. The longitudinal axis of the elongate elliptical portion 18 is horizontally disposed.

Figure 8A:
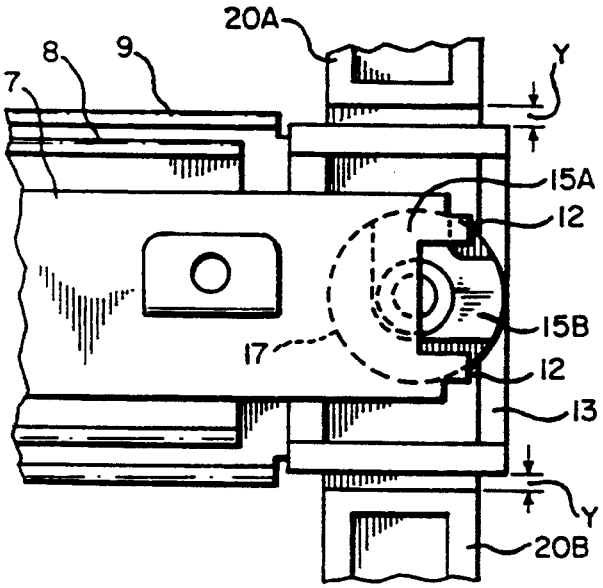
FIGS. 8A and 8B are side views of the present invention viewed from the interior of the cabinet in the drawer-closed and the drawer-open positions, respectively.

FIGS. 8A, 8B, 9A and 9B illustrate the operation of the present invention. In FIG. 8A the interlock mechanism is viewed from the interior of the cabinet in the direction of the left cabinet wall. In FIG. 8A the drawer is fully closed. Portion 15B of cam 14 is directed towards the rear of the cabinet and portion 15A is directed vertically upwardly. The interconnecting stubs 20A and 20B are in their innermost positions showing a gap or distance Y.

Figure 8B:
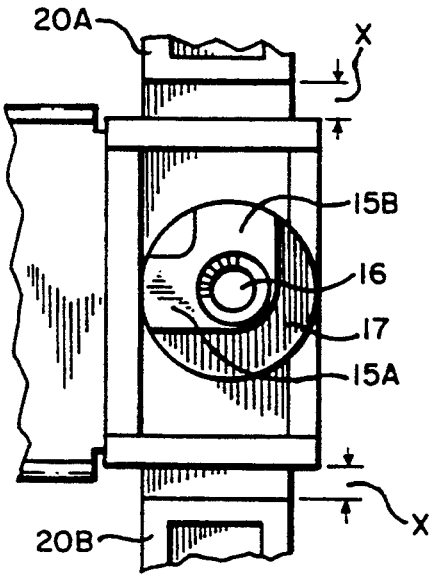

In FIG. 8B the drawer is open. One of the ears 12 has engaged the portion 15A of cam 14 and rotated the cam 90 degrees such that portion 15A of cam 14 is directed towards the front of the cabinet. The rotation of the cam has pressed interconnecting stubs 20A and 20B outwardly to a distance X.

It should be noted at this time that the difference between the sum of the distances X and Y equals the amount of play between the bars and the cams in the interlock system. Thus, when one drawer is open such as shown in 8B, the remainder of the interlock mechanisms of adjacent remaining drawers are in a position shown as 8A, thus preventing rotation of the cam 14.

Figure 9A:
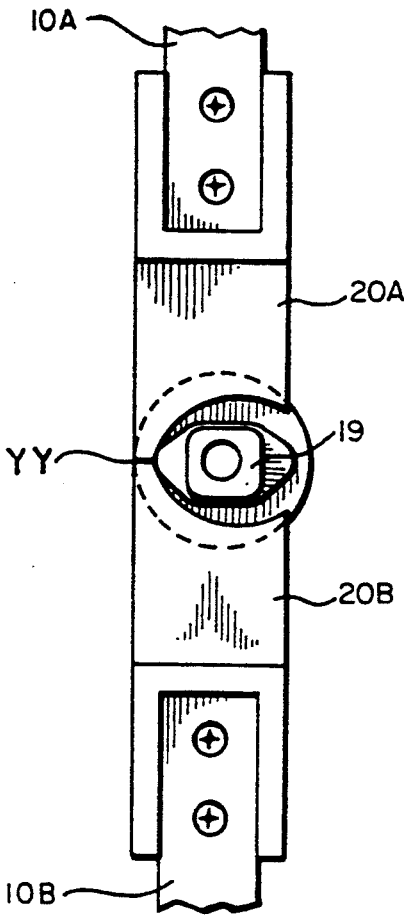
FIGS. 9A and 9B are views of the present invention when viewed from the cabinet wall in the drawer-closed, and drawer-open positions, respectively.

FIG. 9A shows the underside of the interlock mechanism in 8A, in the drawer-closed position. The interlocking bars 20A and 20B are in contact with one another as the longitudinal axis of the elongate elliptical portion 18 of the cam 14 is in a horizontally disposed position.

Figure 9B:
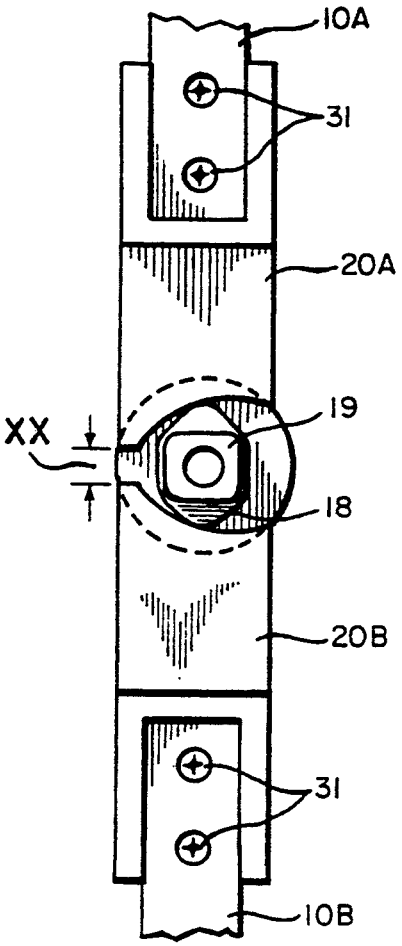

In FIG. 9B the drawer is open. The cam 14 has rotated and elongate elliptical portion 18 has its longitudinal axis vertically disposed. A gap shown by the distance XX has been created.

Thus, when one drawer has been opened as shown in FIG. 9B, the remainder of the drawers will have the interconnecting stubs 20A and 20B of the locking bars 10A and 10B in a position shown in FIG. 9A. The reason for this is that the total "play" or movement within the complete system (i.e. between all the interconnecting stubs and locking bars) is equal to 2 times (X-Y) or XX. Thus, all interlocking stubs, with the exception of those two stubs adjacent to the elongate elliptical portion 18 of the cam which has its longitudinal axis vertically disposed, will be in contact with an adjacent interlocking stub when one drawer is open. This is made possible using a number of locking bars only because, as shown in FIGS. 9A and 9B, the lower left side of stub 20 A and the upper left side of stub 20B is longer than the remainder of the end of the respective stub; and thus with the exception of when the projection 19 is vertically aligned, adjacent stubs are in contact with one another. The force exerted upon the remainder of the cams 14 by interconnecting stubs 20A and 20B of the rest of the drawers will prevent rotation of the the remainder of the cams 14 thus locking the other drawers and preventing their respective retraction from the cabinet.

Although a particular embodiment of the invention has been described, it is understood that any variation of the use of a cam and interlock mounted directly upon the drawer slide, and functioning within the confines of the space between the inner and the outer channels is within the spirit of the present invention.

What we claim as our invention is:

1. An interlock and anti-rebound mechanism for a multi-drawer file cabinet having a vertical series of drawers, each of which is mounted on a pair of progressive drawer slides comprising at least two channel slides, slidably mounted to one another for individual opening and closing movement of the drawer, said interlock and anti-rebound mechanism comprising:

a resilient spring base plate fixedly mounted within a first channel slide;

said resilient spring base plate having at least one aperture in a base portion and including a raised portion at each end;

each of said raised portions including an elongate rectangular slit therethrough;

each of said slits being adapted to receive a curvilinear end portion of a vertically aligned locking bar when in operation;

an activator cam pivotally mounted on said spring base plate within said first channel slide and adapted to move two locking bars outwardly from and inwardly toward said resilient spring base plate, said activator cam comprising at least three different axially-spaced configurations, including an upper L-shaped configuration;

said mechanism further including:

a pair of right angled projections on one end of a second channel slide and integral therewith; said projections extending inwardly, at substantially right angles, towards a web of said first channel slide;

said projections adapted to rotate said L-shaped portion of said activator cam from a drawer-open/-locked position to a drawer-closed/unlocked position;

wherein, in operation, when one of said drawers is pulled outwardly from said cabinet to an open position, said projections interact with said L-shaped portion of said cam and rotate said cam 90 degrees such that a second different axially-spaced configuration of said cam urges an upper and lower locking bar outwardly from said spring base plate, thereby exerting pressure on activator cams and locking bars associated with each other of said drawers in said cabinet, thus preventing the remainder of said cams from rotating and said other drawers from opening;

and when said drawer is retracted into said cabinet, said cam is rotated in the opposite direction 90 degrees to a drawer-closed/unlocked position permitting said locking bars to move inwardly toward said resilient spring base plate thus permitting rotation of any one of said cams associated with said other drawers;

all components of said mechanism functioning within a space defined by outer surfaces of said first and second channel slides.

2. An interlock and anti-rebound device as claimed in claim 1 wherein the second different axially-spaced configuration of said cam comprises:

a pair of diametrically opposed projections which together form an elongate elliptical configuration;

said device comprising the third different axially-spaced configuration of said cam which is substantially square and adapted to act as an anti-rebound means in association with said resilient spring base plate;

whereupon, in operation, a longitudinal axis of said second different configuration is horizontally disposed in the unlocked/drawer-closed position, and vertically disposed in the drawer-open/locked position, said diametrically opposed projections being adapted to matingly engage said curvilinear end portions of said locking bars.

3. An interlock and anti-rebound mechanism as claimed in claim 1 wherein said resilient spring base plate includes five apertures in its base portion; three of said apertures being resilient, such that when in operation said cam is rotated, the third different axially-spaced configuration of said cam deforms said three resilient apertures; said three resilient apertures returning to their original shapes when said cam is in the drawer-closed or drawer-open position.

4. An interlock and anti-rebound mechanism as claimed in claim 3 wherein said third different axially-spaced configuration of said cam in operation, during rotation of the cam, biases the side walls of said three resilient apertures of said resilient spring base plate, and when said cam is in the closed or open position said side walls of said three resilient apertures return to an original configuration, such that said third different axially-spaced configuration of said cam and said resilient apertures resist rotation of said cam in either direction, thereby providing an anti-rebound mechanism for said drawer.

5. An interlock and anti-rebound mechanism as claimed in claim 3 wherein two of said apertures in said resilient spring base plate are round and adapted to receive rivets for affixing said resilient spring base plate to said first channel slide; the remainder of said apertures being of a deformable rectangular configuration; each of said apertures with the deformable rectangular configuration, having at least one resilient side and one of said rectangular configured apertures being centrally located and substantially square.

6. An interlock and anti-rebound mechanism as claimed in claim 1 wherein said actuator cam comprises four axially-spaced different configurations comprising the first upper L-shaped configuration, a second round base plate configuration, a third elongated elliptical configuration and a fourth inner square configuration.

7. An interlock and anti-rebound mechanism as claimed in claim 1 wherein, in operation said outer surfaces and said first and second channel slides are fixedly attached to an inner side wall of the cabinet and an outer side wall of the drawer, respectively.

8. An interlock and anti-rebound mechanism as claimed in claim 1 wherein said progressive drawer slides comprising an outer first channel slide, an intermediate channel slide and an inner second channel slide;

said resilient spring base plate and said activator cam being mounted within said first outer channel slide and said pair of right angled projections extending inwardly from and being integral with said second inner channel slide.

9. An interlock and anti-rebound mechanism for a multi-drawer file cabinet having a vertical series of drawers, each of which is mounted on a pair of progressive drawer slides including at least two channel slides, slidably mounted to one another for individual opening and closing movement of the drawer, said interlock and anti-rebound mechanism comprising:

a spring base plate fixedly mounted on a first channel slide;

said spring base plate having at least one aperture in a base portion and including a raised portion at each end;

each of said raised portions including an elongate rectangular slit therethrough;

each of said slits being adapted to receive a curvilinear end portion of a vertically aligned locking bar when in operation;

an activator cam pivotally mounted on said spring base plate within said first channel slide and adapted to move two locking bars outwardly from and inwardly toward said spring base plate, said activator cam comprising at least three different axially-spaced configurations, including an upper L-shaped configuration;

a pair of right angled projections extending at substantially right angles to a web of a second channel slide and integral therewith;

said projections adapted to rotate said L-shaped portion of said activator cam from a drawer-open/-locked position to a drawer-closed/unlocked position;

wherein, in operation, when one of said drawers is pulled outwardly from said cabinet to an open position, said projections interact with said L-shaped portion of said cam and rotate said cam 90 degrees such that the second different axially-spaced configuration of said cam urges an upper and lower locking bar outwardly from said spring base plate, thereby exerting pressure on activator cams and locking bars associated with the other of said drawers in said cabinet, thus preventing the remainder of said cams from rotating and said other drawers from opening;

and when said drawer is retracted into said cabinet, said cam is rotated in the opposite direction 90 degrees to a drawer-closed/unlocked position permitting said locking bars to move inwardly toward said spring base plate and of any one of said cams associated with said other drawers.

10. An anti-rebound mechanism as claimed in claim 9 wherein said spring base plate includes five apertures in its base portion; three of said apertures being resilient, such that when in operation said cam is rotated, the third different axially-spaced configuration of said cam deforms said three resilient apertures; said three resilient apertures returning to their original shapes when said cam is in the drawer-closed or drawer-open position.

11. An interlock and anti-rebound mechanism as claimed in claim 10 wherein said third different axially-spaced configuration of said cam is substantially square; whereupon in operation, during rotation of the cam, said square configuration biases the side walls of said three resilient apertures of said spring base plate and when said cam is in the closed or open position said side walls of said central apertures resiliently return to an original configuration, such that said square different axially-spaced configuration of said cam and said central apertures resist rotation of said cam in either direction, thereby providing an anti-rebound mechanism for said drawer.

12. An interlock and anti-rebound mechanism as claimed in claim 10 wherein two of said apertures in said spring base plate are round and adapted to receive rivets for affixing said spring base plate to said channel; the remainder of said apertures being of a deformable rectangular configuration, having at least one resilient side and one of said rectangular configured apertures being centrally located and substantially square.

* * * * *